United States Patent [19]

O'Rourke et al.

[11] 4,134,335

[45] Jan. 16, 1979

[54] WASTE COMPACTING APPARATUS

[75] Inventors: James O'Rourke, Waldwick, N.J.; Murray Feldberg, Brooklyn, N.Y.

[73] Assignee: Multi-Pak Corporation, Hackensack, N.J.

[21] Appl. No.: 867,934

[22] Filed: Jan. 9, 1978

Related U.S. Application Data

[63] Continuation of Ser. No. 626,268, Oct. 28, 1975, abandoned.

[51] Int. Cl.[2] ..... B30B 15/08

[52] U.S. Cl. ..... 100/98 R; 100/179; 425/376 R

[58] Field of Search ..... 100/39, 98 R, 179, 229 A; 53/124 B; 425/376 R

[56] References Cited

U.S. PATENT DOCUMENTS

| | | | |
|---|---|---|---|
| 277,439 | 5/1883 | Ballagh | 100/98 R |
| 2,203,884 | 6/1940 | Stone | 100/98 R UX |
| 2,591,970 | 4/1952 | Seegers | 100/98 R |
| 3,384,007 | 5/1968 | Boje et al. | 100/98 R X |
| 3,541,949 | 11/1970 | Clar | 100/229 A X |
| 3,604,345 | 9/1971 | Boje | 100/98 R X |
| 3,734,005 | 5/1973 | Vogel | 100/229 A X |

FOREIGN PATENT DOCUMENTS

| | | | |
|---|---|---|---|
| 845438 | 11/1952 | Fed. Rep. of Germany | 100/98 R |

*Primary Examiner*—Billy J. Wilhite

*Attorney, Agent, or Firm*—Cooper, Dunham, Clark, Griffin & Moran

[57] ABSTRACT

A waste compacting apparatus includes an elongated waste receiving chamber of rectangular cross section, a size reduction chamber of decreasing rectangular cross section and an elongated outlet snout of rectangular cross section affixed to the smaller end of the size reduction chamber. A compaction ram having a forward-protruding shearing knife is slidably mounted in the waste receiving chamber and is adapted for reciprocating movement between a rearward position that permits waste to be loaded into said elongated waste receiving chamber and a forward position up to the point of size reduction.

3 Claims, 4 Drawing Figures

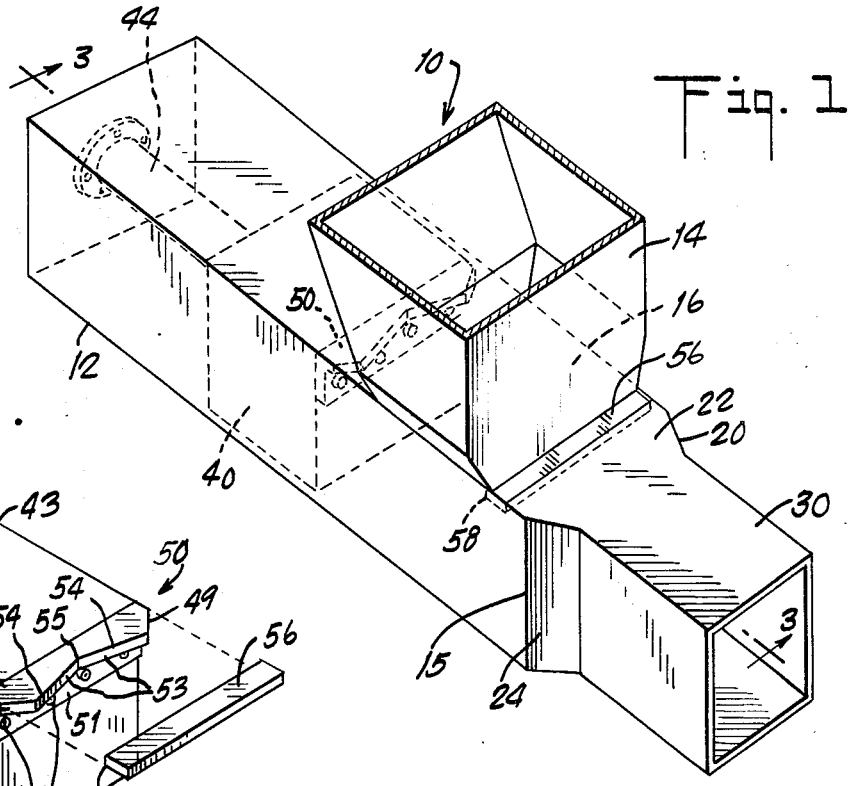
Fig. 1.
Fig. 2.
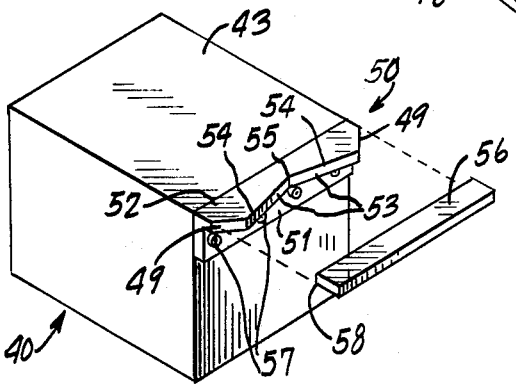
Fig. 3a.
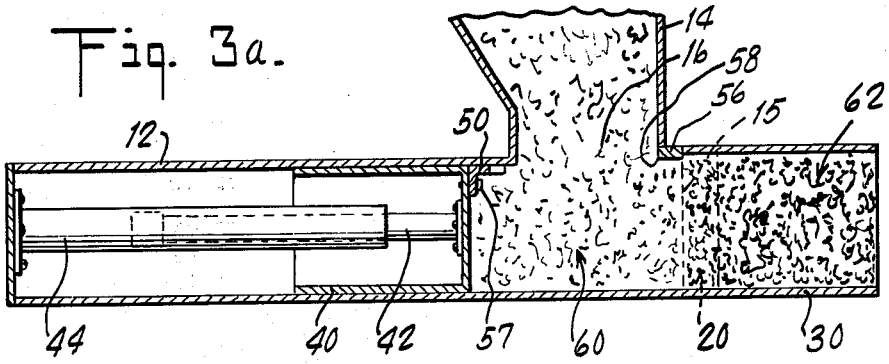
Fig. 3b.
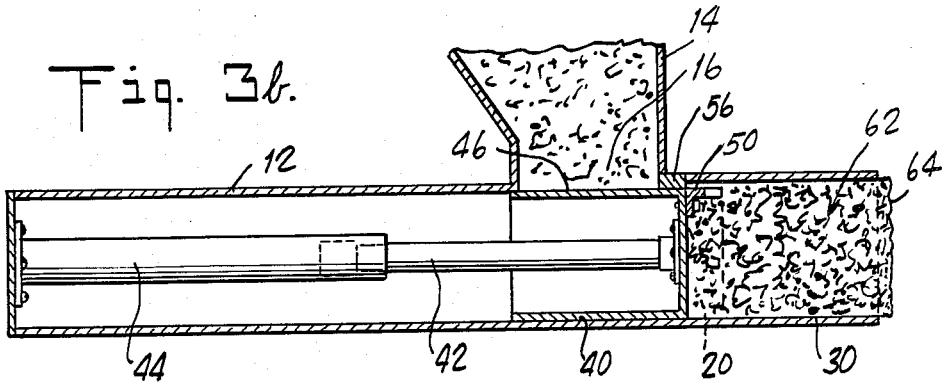

WASTE COMPACTING APPARATUS

This is a continuation of application Ser. No. 626,268 filed Oct. 28, 1975 now abandoned.

BACKGROUND OF THE INVENTION

The invention relates to a waste compacting apparatus, and relates more particularly to a waste compacting apparatus having a size reduction chamber of rectangular cross section and a compaction ram adapted for movement up to the point of size reduction.

The desirability of using size reduction chambers in waste compacting devices has long been recognized. Representative prior art devices employing this concept are shown in U.S. Pat. Nos. 3,384,007, 3,541,949, 3,802,337 and 3,815,323.

The most common arrangement, as shown in U.S. Pat. Nos. 3,384,007 and 3,802,337, employs a size reduction chamber in the shape of a truncated cone which connects a cylindrical waste receiving chamber to a cylindrical outlet snout of smaller diameter. In U.S. Pat. No. 3,541,949, a waste receiving chamber of polygonal cross section is coupled to an outlet snout of circular cross section by a transitional portion having a polygonal cross section at its inlet side and a more rounded cross section at its outlet side. In U.S. Pat. No. 3,815,323, a plurality of elongated flutes extend from the inner surface of a tubular chamber of uniform diameter to reduce the cross sectional area of a portion of the chamber.

The reduction chambers discussed above reduce chamber size either in all directions, or at least in a plurality of radial directions. These configurations require that there be no substantial protrusions around the forward peripheral portions of the compacting ram, since any such protrusion would come in contact with a portion of the size reduction chamber and prevent further forward motion of the compacting ram. This drawback has resulted in the use of a serrated shearing edge on the upper peripheral surface of the ram, as typically shown in FIG. 3 of U.S. Pat. No. 3,384,007. This type of shearing edge permits full ram travel up to the point of size reduction, which is desirable for efficient compacting, but suffers a number of drawbacks in terms of shearing efficiency and durability. The use of a serrated shearing edge also increases the likelihood of jamming, and the cutting teeth are subject to breakage. Finally, if the cutting teeth protrude even slightly from the forward edge of the ram in a system employing a prior art size reduction chamber, as shown in FIG. 2*b* of U.S. Pat. No. 3,802,337, the ram must necessarily stop short of the size reduction chamber to avoid interference between the protruding cutting edges and the tapering walls of the size reduction chamber, and this results in decreased compaction efficiency.

SUMMARY OF THE INVENTION

One object of the present invention is to provide a waste compacting apparatus having a size reduction chamber which permits full ram travel even when a protruding cutting edge is present on a portion of the periphery of the compaction ram.

A further object of the invention is to provide a waste compacting apparatus having a strong and efficient protruding shearing knife for use in the improved size reduction chamber.

These and other objects of the invention are achieved by providing a waste compacting apparatus with a size reduction chamber of decreasing rectangular cross section in which one pair of opposite walls are parallel while a second pair of opposite walls taper inwardly to provide the desired size reduction. The size reduction chamber connects an elongated waste receiving chamber of rectangular cross section to an elongated outlet snout of smaller rectangular cross section than that of the waste receiving chamber. A compaction ram of rectangular cross section is slidably mounted in the waste receiving chamber and is capable of reciprocating movement between a rearward position, which permits waste to be loaded into the waste receiving chamber through a waste inlet opening, and a forward position in which the ram is at the waste outlet opening of the waste receiving chamber. In the forward ram position, a shearing knife is affixed to a forward edge of the ram and protrudes therefrom to extend within the size reduction chamber. Interference between the shearing knife and the size reduction chamber is prevented by having the shearing knife enter the size reduction chamber along a non-tapering surface and by tapering the sides of the shearing knife.

BRIEF DESCRIPTION OF THE DRAWINGS

FIG. 1 is a perspective view of a waste compacting apparatus in accordance with the invention;

FIG. 2 is a perspective view of a compaction ram and its associated shearing knives;

FIG. 3*a* is a cross-sectional view taken along the line 3—3 in FIG. 1, with the compaction ram in its rearward position; and FIG. 3*b* is a cross-sectional view as in FIG. 3*a* but with the compaction ram in its forward position.

DETAILED DESCRIPTION

Referring to FIG. 1 of the drawings, there is shown a waste compacting apparatus generally identified by the reference numeral 10. The lower portion of waste compacting apparatus 10 comprises three main portions; an elongated waste receiving chamber 12, a size reduction chamber 20 and an elongated outlet snout 30. Each of these three portions is of generally rectangular cross section, with the waste receiving chamber and outlet snout of constant rectangular cross section, while the size reduction chamber is of decreasing rectangular cross section and has its smaller end affixed to the outlet snout.

The waste receiving chamber 12 houses a compaction ram 40 which is slidably mounted within the waste receiving chamber and is driven between a rearward position and a forward position by a driving means 44 which is coupled to the compaction ram by a driving shaft 42. The driving means and shaft are of conventional design, and therefore are not described in detail.

The waste receiving chamber accepts refuse from a feeding chute 14 through a waste inlet opening 16 in the upper surface of the waste receiving chamber. An upper shearing knife 56 is affixed within the top wall of the waste receiving chamber and extends across the upper surface of the chamber at the forward edge of waste inlet opening 16. A lower shearing knife 50 is affixed to the top forward edge of compaction ram 40 by fastening means 57 and slidably contacts the lower protruding knife edge 58 of upper shearing knife 56 as the ram is driven toward the forward position.

Waste receiving chamber 12 is joined to size reduction chamber 20 at a waste outlet opening 15 at the forward end of the former. In the embodiment shown in FIG. 1, the size reduction chamber 20 has a pair of parallel horizontal walls 22 and a second pair of vertical walls 24 which taper inwardly away from the waste outlet opening 15. The rectangular cross section of the size reduction chamber 20 decreases as the distance from waste outlet opening 15 increases, with the entire reduction being accomplished by a decrease in chamber width, while the chamber height remains constant.

Although the exact dimensions of the size reduction chamber are not critical, efficient operation may be obtained by having the vertical size reduction chamber walls 24 taper inwardly at an angle of between about 35° and about 55°, while the width of the vertical walls should be selected to reduce the width of the far end of the size reduction chamber to about three-quarters to one-half the width of the near end adjacent the waste outlet opening 15. Clearly, the greater the taper angle and the larger the width of the vertical walls, the greater will be the degree of compaction.

The smaller end of size reduction chamber 20 is connected to elongated outlet snout 30, which has a constant rectangular cross section equal to that of the smaller end of the size reduction chamber. The exact length of outlet snout 30 is not critical, but this snout should be sufficiently long to permit the use of appropriate rigid waste containers or flexible bags as desired. As the length of snout 30 is increased, the degree of compaction will increase, due to the added friction between the compacted waste and the walls of the outlet snout.

A perspective view of the compaction ram 40 and its associated shearing knives is shown in FIG. 2. The lower shearing knife 50 is affixed to the top forward edge of the compaction ram 40 by fasteners 57, with the upper knife surface 52 extending forward along the plane of the upper surface 43 of the compaction ram. The shearing knife has a vertical rear plate 51 which serves both as a suitable mounting plate for attaching the knife to the compaction ram and as a strengthening member for the knife structure. Since the knife 50 is a complete and separate structure, it may be removably fastened to the compaction ram by using suitable bolt fasteners or the like in order to facilitate removal and replacement. Furthermore, provisions can easily be made for adjustment of the lower shearing knife to maintain proper alignment and to compensate for wear. This is in contrast to the typical prior art ram structure having an integral serrated shearing knife, in which case the knife is neither replaceable nor adjustable. By making the lower shearing knife removable and adjustable, a significant saving in both maintenance costs and down time can be achieved. Cutting surface wear, for example, may be compensated for by a simple adjustment, and a damaged blade can be removed without removing the compaction ram from the waste compacting apparatus.

Forward vertical knife surfaces 53 of the lower shearing knife 50 and corresponding upper knife edges 54 are in a vee configuration at their middle portions, with the central vee tip 55 pointing rearwardly. In this configuration, the maximum, shearing force is generated at the vee tip 55, which is in the same plane as the center lines of the compaction ram upper surface and driving shaft 42. Undesirable side forces acting on the ram are thereby minimized, and the point of maximum shearing force is in line with driving shaft 42 for maximum strength.

In order to permit the forward-extending knife 50 to enter the size reduction chamber 20, the knife is provided with beveled side surfaces 49, which taper inwardly at an angle corresponding to the taper angle of the vertical walls 24 of the size reduction chamber.

Also shown in FIG. 2 is the upper straight edge shearing knife 56, which is affixed within the upper surface of the waste receiving chamber as shown in FIG. 1. Upper shearing knife 56 is provided with a lower cutting edge 58 which slidably contacts the upper edges 54 of lower shearing knife 50 as the compaction ram is driven forward toward the waste inlet opening 15.

The operation of the waste compacting apparatus may be more clearly understood with reference to the cross-sectional views of FIGS. **3*a* and 3*b*. In FIG. 3*a* the compaction ram 40 is shown in a rearward position behind the waste inlet opening 16. Loose waste 60 is delivered to the forward portion of the waste receiving chamber 12 from chute 14 through waste inlet opening 16. In FIG. 3*a* size reduction chamber 20 and outlet snout 30 are shown containing compacted waste 62 from previous compaction cycles. When the forward portion of the waste receiving chamber 12 is filled, compaction ram 40 is driven forward until the front edge of the ram reaches waste outlet opening 15, as shown in FIG. 3*b*. At this point the lower shearing knife 50 extends into the size reduction chamber, but does not interfere therewith due to the beveled knife edges 49. Shortly before the compaction ram reaches the forward position of FIG. 3*b*, lower shearing knife 50 slidably contacts upper shearing knife 56 in order to forcefully and efficiently shear any objects which do not completely clear the waste inlet opening 16**.

Compaction begins as the uncompacted waste 60 is forced forward through the waste receiving chamber 12 toward its waste outlet opening 15. Waste extending above the upper horizontal surface of the waste receiving chamber is sheared as lower shearing knife 50 meets upper shearing knife 56, and the waste remaining in the waste receiving chamber is forced into size reduction chamber 20 where a further compaction of the already-compressed waste occurs. Thus, each new charge of uncompacted waste in the waste receiving chamber is compressed by the reciprocating action of the ram operating against the resistance of the previously compacted waste 62 in the size reduction chamber 20 and the outlet snout 30. At the completion of each cycle, a portion of the compacted waste 62 in the outlet snout is forced outside the waste compacting apparatus, as shown in FIG. **3*b* at 64. For each compaction cycle of the ram, the length of compressed waste 64** discharged from the compactor will be only a few inches, with the exact length depending upon the degree of size reduction in the size reduction chamber, and to a lesser extent upon the length of the outlet snout.

As a result of the unique configuration of the size reduction chamber and shearing knife system, full ram travel up to the point of size reduction is obtained while at the same time a durable, efficient, easily adjustable and removable waste shearing system is achieved.

While the invention has been particularly shown and described with reference to a preferred embodiment thereof, it will be understood by those skilled in the art that various changes in the form and details may be made therein without departing from the spirit and scope of the invention.

What is claimed is:

1. A waste compacting apparatus which comprises:

an elongated waste receiving chamber of generally rectangular cross section, said chamber having a waste inlet opening intermediate the chamber ends and a waste outlet opening at the forward end thereof;

a size reduction chamber of decreasing rectangular cross section affixed at its rear end to said waste outlet opening, said size reduction chamber having a first opposite pair of parallel walls and a second opposite pair of walls tapering inwardly toward the far end of said size reduction chamber; an elongated outlet snout of rectangular cross section equal to that of the far end of said size reduction chamber, said outlet snout having its near-end affixed to the far end of said size reduction chamber and having a discharge opening at its outlet end;

a compaction ram having a rectangular cross section and a substantially flat waste-compacting face at its forward end, said ram being slidably mounted in said elongated waste receiving chamber and adapted for reciprocating movement between a rearward position behind said waste inlet opening and a forward position at the near end of said size reduction chamber;

means for driving said compaction ram between said rearward position and said forward position;

an upper straight-edge shearing knife affixed within said waste receiving chamber and extending across and projecting downwards from the upper surface thereof normal to the sides of said receiving chamber and adjacent the forward edge of said waste outlet opening; and a unitary lower vee-shaped shearing knife affixed to and extending forward from the top forward edge of the waste-compacting face of said compacting ram with the central vee tip thereof pointing rearwardly and being in the same plane as the center line of said compaction ram's upper surface and of said drive means, said lower shearing knife slidably contacting said upper shearing knife as said ram is driven forward toward said waste inlet opening.

2. A waste compacting apparatus as in claim 1, wherein the parallel walls of said size reduction chamber are horizontal walls, and the tapering walls of said chamber are vertical walls.

3. A waste compacting apparatus as in claim 1, wherein the forward portions of the side surfaces of said lower vee-edged shearing knife are beveled inwardly to permit said lower knife to enter said size reduction chamber.

* * * * *